US006325015B1

(12) United States Patent
Garcia et al.

(10) Patent No.: US 6,325,015 B1
(45) Date of Patent: Dec. 4, 2001

(54) SYSTEM FOR ARRESTING A SEAGOING VESSEL

(75) Inventors: Felipe Garcia, Panama City; Robert Woodall; Christopher Doyle, both of Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/698,663

(22) Filed: Oct. 30, 2000

(51) Int. Cl.[7] ..... B63B 38/00
(52) U.S. Cl. ..... 114/382; 114/240 C
(58) Field of Search ..... 114/382, 240 C

(56) References Cited

U.S. PATENT DOCUMENTS 4,768,417 * 9/1988 Wright ..... 102/46
5,069,109 * 12/1991 Lavan, Jr. ..... 114/240 C

* cited by examiner

*Primary Examiner*—Jesus D. Sotelo
(74) *Attorney, Agent, or Firm*—Harvey A. Gilbert; Donald G. Peck

(57) ABSTRACT

A system for arresting a fleeing seagoing vessel deploys a net using one or more self-propelled vehicles from a platform. The net is flown over and draped onto a seagoing vessel of interest such that a portion of the net's periphery resides in the water. Drag devices are coupled to the net to generate drag forces at the portion of the net's periphery in the water as the seagoing vessel moves through the water. The system can also include a variety of non-lethal weapon systems that are coupled to or incorporated with the net, and designed to subdue the crew of the vessel and/or the vessel's engine and electronic components.

60 Claims, 7 Drawing Sheets

SYSTEM FOR ARRESTING A SEAGOING VESSEL

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to the capture of a fleeing seagoing vessel, and more particularly to a system that slows and/or incapacitates a fleeing seagoing vessel from a pursuing platform.

BACKGROUND OF THE INVENTION

Military and law enforcement operations need the ability to stop or significantly slow a rapidly fleeing maritime vessel without harming the occupants of the fleeing craft. In certain situations, it may also be necessary to incapacitate the occupants of the fleeing vessel. Often, the operators of such vessels are involved with illegal smuggling operations. For effective legal prosecution, law enforcement must capture these individuals with contraband. The problem is that smugglers tend to run when confronted by law enforcement. Resulting high-speed boat chases may last for several hours. In many cases, the fleeing vessel is fast and filled with enough fuel that the law enforcement agency can reach but not catch the fleeing vessel before it enters foreign waters or before the law enforcement watercraft runs out of fuel. Since most smugglers do not fire upon law enforcement when they run, law enforcement is precluded from using lethal means to stop the fleeing vessel.

Previous methods used to stop such fleeing vessels use ropes and/or metallic lines launched ahead of the fleeing vessel with the hope that it will travel over the extended line and pull it into the vessel's propeller. This method is limited in area of coverage and thus is often eluded by maneuverable vessels that simply steer away from the line in the water. Additionally, vessels that do travel over the line often do not get entangled in the line and continue on their way. Further, large vessels with large propellers simply shred the line, cut the line using propeller guards or line cutters, or carry the line along without any degradation in speed. Impeller jet propelled vessels are not susceptible to entanglement with such lines.

Other currently-used capture methods include the use of lines with harpoon-like devices that are fired and attached to the fleeing vessel. The opposite end of the line is secured to the pursuing vessel. This method is limited because it can only be used on fiberglass and wooden hulls and is virtually useless on a hull of substantial thickness or a hull made of steel. Additionally, this method adds an element of risk to the pursuing vessel since dynamic loads between the two vessels connected by a line can be formidable. The loads can cause hull failure, sinking of the vessel and inadvertent injuries and/or loss of life. Further, the tension in the line itself can be sufficient to break the line and send it flying with great lethal capacity toward people on either vessel.

SUMMARY OF THE INVENTION

Accordingly, it is an object of the present invention to provide a system that can slow and/or incapacitate a fleeing seagoing vessel.

Another object of the present invention is to provide a system that can be deployed from a pursuing vehicle to arrest a fleeing seagoing vessel.

Still another object of the present invention is to provide a system that can slow and/or incapacitate a fleeing seagoing vessel and initiate activation of a non-lethal weapon against the seagoing vessel and/or its occupants.

Yet another object of the present invention is to provide a system for slowing and/or incapacitating a fleeing seagoing vessel without endangering personnel on a pursuing vehicle.

Other objects and advantages of the present invention will become more obvious hereinafter in the specification and drawings.

In accordance with the present invention, a system for arresting a fleeing seagoing vessel includes a net having a periphery. The net is deployed by one or more self-propelled vehicles from a platform. The net is flown over and draped onto a seagoing vessel of interest such that a portion of the net's periphery resides in the water. Drag devices are coupled to the net to generate drag forces at the portion of the net's periphery in the water as the seagoing vessel moves through the water. The drag forces are imparted to the net which, in turn, imparts the drag forces to the vessel and slow the speed thereof. The use of the net disperses the dynamic drag forces throughout the entirety thereof thereby limiting the potential for failure of single or multiple strength members of the net. Continuing forward motion of the vessel can ultimately cause overheating and destruction of the engines of the vessel. Still further, the net may become entangled in the propulsion system (e.g., propellers) of the vessel thereby quickly incapacitating same. A variety of non-lethal weapon systems can also be coupled to or incorporated with the net. The weapon systems are designed to subdue the crew of the vessel and/or the vessel's engine and electronic components.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
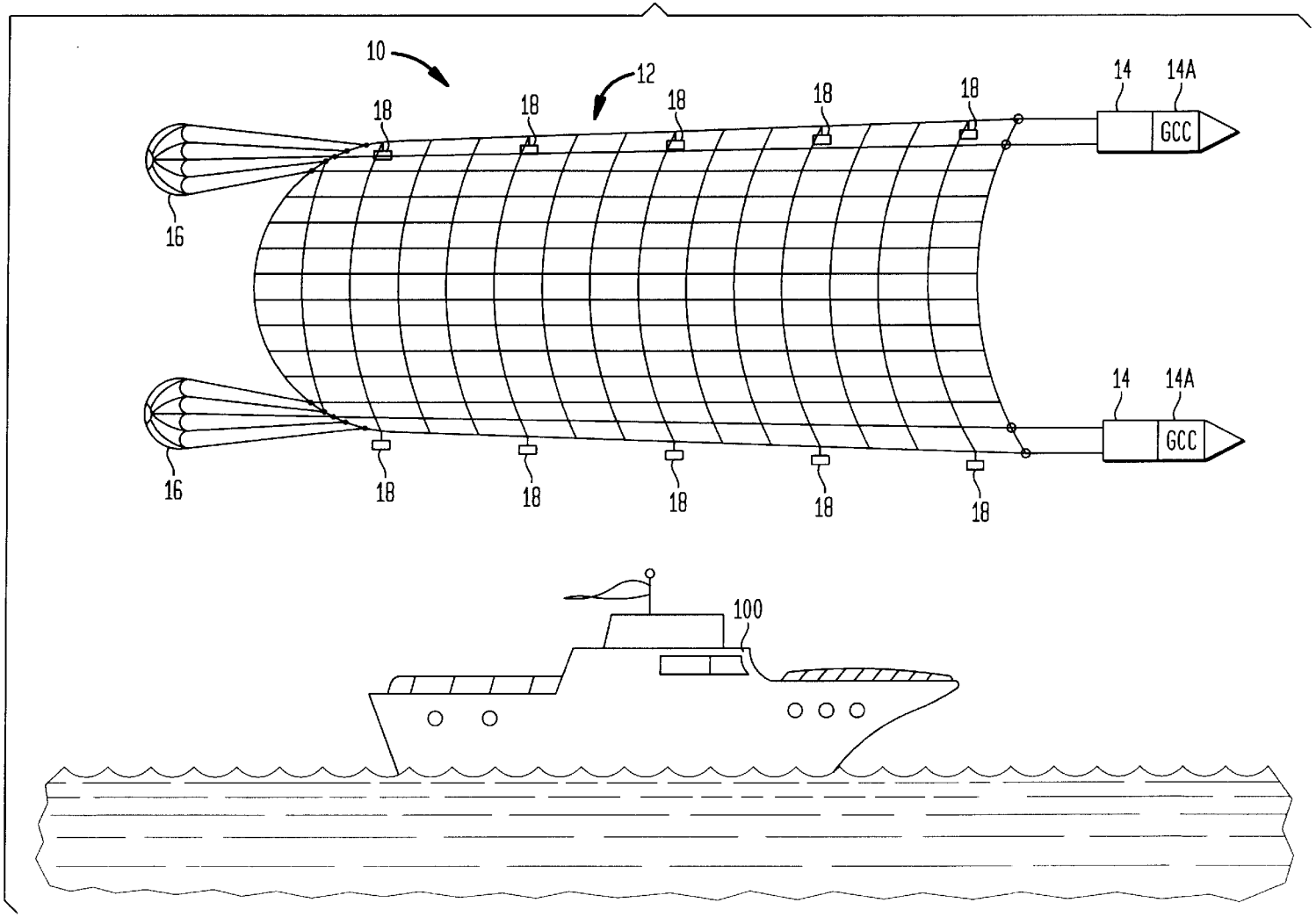
FIG. 1 is a schematic view of one embodiment of the arresting system of the present invention in its airborne phase enroute to being draped over a fleeing seagoing vessel.
Figure 2:
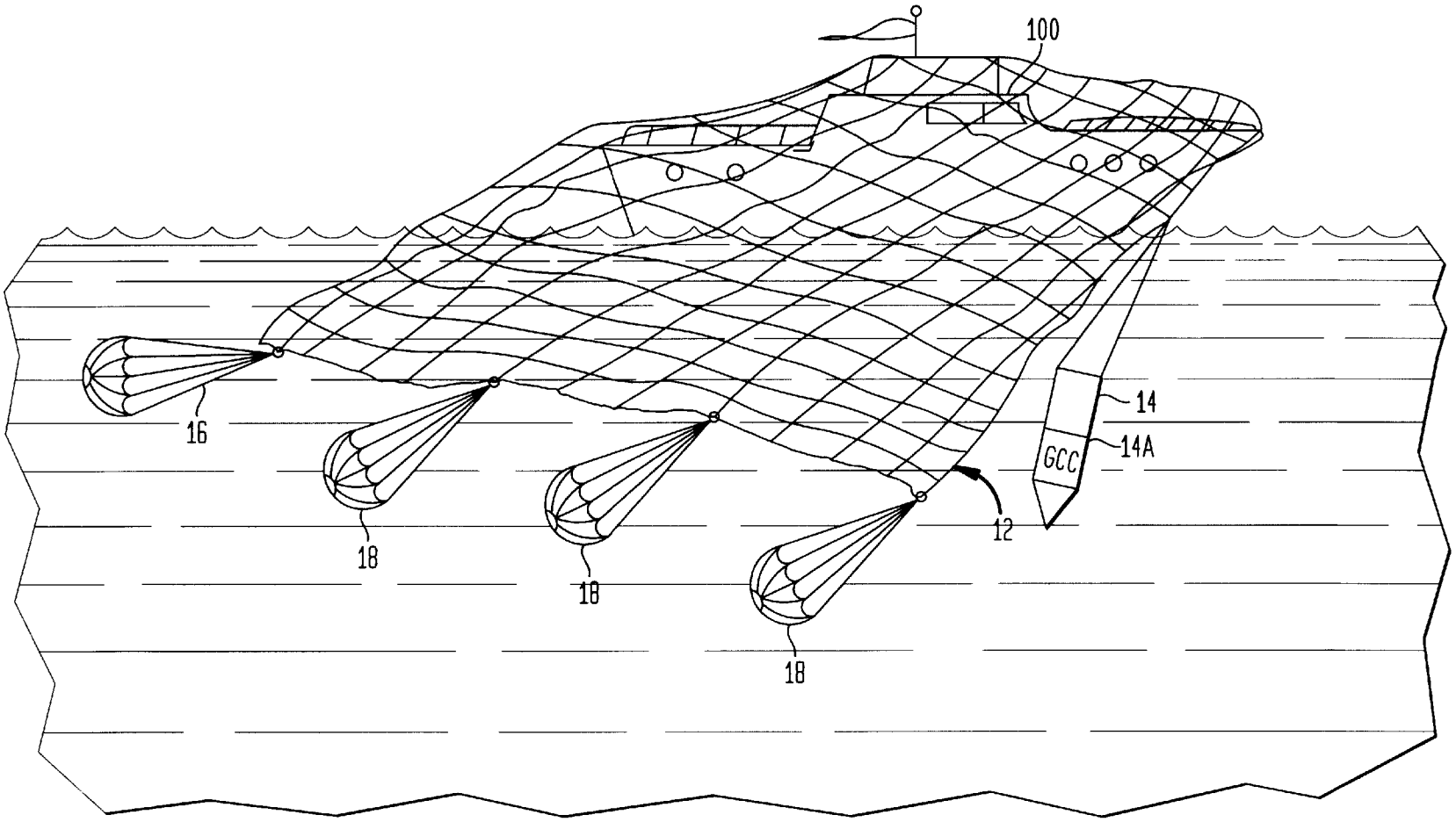
FIG. 2 is a schematic diagram of the arresting system of FIG. 1 draped over the fleeing vessel.

Referring now to the drawings, and more particularly to FIGS. 1 and 2, one embodiment of a system 10 for arresting a fleeing seagoing vessel 100 is illustrated. Arresting system 10 is referenced generally in FIG. 1 where it is shown in its airborne phase. In FIG. 2, system 10 is illustrated in its operational phase. Arresting system 10 is assumed to have been launched from a platform (not shown) such as a pursuing aircraft or seagoing vessel belonging to law enforcement authorities. The launch platform and choice thereof are not limitations of the present invention. Various launch configurations will be described below.

Once launched, arresting system 10 assumes a configuration shown schematically in FIG. 1. That is, arresting system 10 includes a net 12 propelled through the air by one or more self-propelled vehicles or rockets (two are illustrated in this embodiment) 14 attached to the front of net 12. Rockets 14 can be directed at slightly diverging angles to assure the full opening of net 12. Towards this same goal, the aft end of net 12 can have one or more (two are illustrated) net opening devices (e.g., parachutes) 16 attached thereto. Attached about the periphery of net 12 are a plurality of devices 18 that can induce drag forces in water as will be described later herein.

Net 12 is made from a high-strength, flexible material that is difficult to cut. Suitable materials include, for example, various commercially-available synthetic fibrous materials that can be used to construct net 12. Such synthetic fibers include, for example, nylon, polyesters, aramids (e.g., KEVLAR), polyaramids and polyethylenes, just to name a few. The flexible nature of net 12 will allow it to be easily folded/packed into a pre-deployment package. The high-strength nature of net 12 will allow it to withstand launch forces and drag forces experienced during its use.

The "difficult to cut" nature of net 12 will make it difficult or impossible for occupants (not shown) of fleeing vessel 100 to cut net 12. The size of net 12 should be such that it can be substantially or fully draped over fleeing vessel 100 such that the net's periphery and many of drag-producing devices 18 reside in the water surrounding fleeing vessel 100 as best seen in FIG. 2. The particular shape of net 12 is not a limitation of the present invention.

Rockets 14 represent any currently-available or specially-designed self-propelled vehicles that can be used to propel net 12 through the air. Rockets 14 can follow a predetermined ballistic path selected at launch that will cause net 12 to land on fleeing vessel 100. Rockets 14 can also be equipped with guidance and control computers (GCC) 14A as illustrated to provide for the in-flight maneuvering of net 12 thereby allowing system 10 to track evasive actions by fleeing vessel 100. Such guidance and control systems are well known in the art and, therefore, need not be described further herein.

Net opening devices 16 can be any device(s) that will aid in the opening of net 12 to its fullest extent during flight. Accordingly, devices 16 can be coupled to net 12 wherever needed to aid in the opening of net 12, e.g., the aft end, sides or middle of net 12. Choices for devices 16 include parachutes as shown, or glide vehicles or weights that vector outward from the forward path of net 12 as net 12 flies forward.

Drag inducing devices 18 can be any object or system that will generate drag forces that can be imparted to net 12 as devices 18 move through water. Accordingly, devices 18 can include parachutes deployed in the water, streamers released into the water, anchors, buckets, balloons that fill with gas when deployed in the water, weights, self-propelled vehicles designed to travel in a direction opposite that of fleeing vessel 100, other devices that will induce drag forces in the water, or any combination of the above. Note that if drag devices 18 do not weigh enough to cause the periphery of net 12 to sink in the water, weights (not shown) can be attached to net 12. By way of example, drag devices 18 can be underwater parachutes. Such underwater parachutes are typically furled prior to deployment by means of small lines which can be cut by tension-activated reefing line cutters. Such reefing line cutters are available commercially from Roberts Research Laboratory, Torrance, Calif.

After net 12 has been draped on fleeing vessel 100 with a substantial number or all of drag inducing devices 18 residing in the surrounding water, the present invention acts to slow and/or incapacitate fleeing vessel 100 in one or more ways. For example, as illustrated, devices 18 are parachutes that open in water to generate drag forces as fleeing vessel 100 continues to move forward dragging net 12 therealong. The drag forces are imparted to net 12 which, in turn, imparts the drag forces to fleeing vessel 100 to slow fleeing vessel 100 to a speed at which it can be overtaken and/or boarded. The use of net 12 disperses the dynamic drag forces throughout the entirety thereof thereby limiting the potential for failure of single or multiple strength members of net 12. Continuing forward motion of fleeing vessel 100 is slowed under the high drag loads imposed by net 12. Further, continued operation of fleeing vessel 100 can ultimately cause overheating and destruction of the engines of fleeing vessel 100. Still further, net 12 may become entangled in the propulsion system (e.g., propellers) of fleeing vessel 100 thereby quickly incapacitating same.

While the above description addresses the basic concept of the present invention, the present invention can include a weapon system designed to incapacitate fleeing vessel 100 and/or its crew. Such a weapon system can be lethal or non-lethal in a nature. However, since the present invention will generally be used when lethal force is neither warranted nor permitted, the description herein will focus on a variety of non-lethal weapon systems. The weapon system can be explosive, chemical and/or electrical in nature. That is, upon initiation, the weapon system could deliver an explosive force designed to have an effect on the crew of fleeing vessel 100 (or the vessel itself). Additionally or alternatively, the weapon system could be designed to deliver a chemical substance(s) that have an effect on the crew and/or fleeing vessel 100. Additionally or alternatively, the weapon system could deliver an electrical force that affects the crew and/or fleeing vessel 100. Initiation of such weapon system(s) can occur automatically (e.g., when an attempt is made to cut net 12, when tension is generated in net 12 as described above etc.) or under remote control from, for example, the pursuing vehicle. Several non-limiting examples of weapon systems and initiation schemes will be explained below.

Figure 3A:
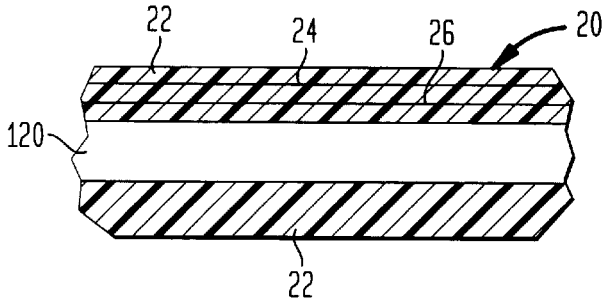
FIG. 3A is a schematic view of a section of the arresting net's strength member surrounded by an explosive or electric-shock type of weapon system that is initiated when an attempt is made to cut the net.
Figure 3B:
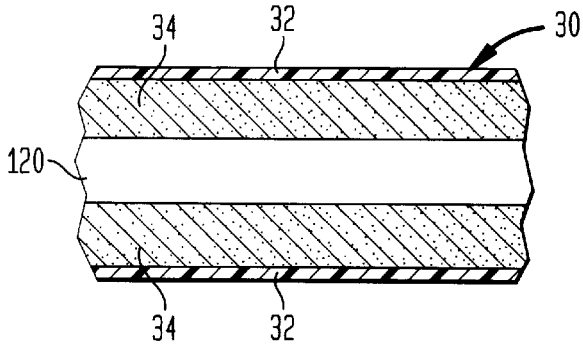
FIG. 3B is a schematic view of a section of the arresting net's strength member surrounded by a chemical type of weapon system that is initiated when an attempt is made the cut the net.

As mentioned above, the goal of the present invention is to slow and/or incapacitate fleeing vessel 100 so that it can be overtaken. Accordingly, it may only be desired to initiate a weapon system if/when attempts are made (onboard fleeing vessel 100) to cut net 12. Examples of such weapon systems are illustrated in FIGS. 3A and 3B where a small section of the net's strength member is illustrated along with a weapon system. In FIG. 3A, a weapon system 20 is formed about a strength member 120 of net 12. Weapon system 20 surrounds strength member 120, and includes a sheath 22 having electrical conductors 24 and 26 extending therein and separated from one another by a material 28. If weapon system 20 is cut into, presumably with a metal implement, conductors 24 and 26 will be pressed into engagement to complete an electrical circuit that can generate a shock. The electric shock could also be used to detonate material 28 which can be an explosive. In FIG. 3B, a chemical weapon system 30 includes a sheath 32 surrounding strength member 120 and a chemical agent or substance 34 that is emitted when sheath 32 is cut. Chemical substance 34 can take the form of a variety of non-lethal noxious substances such as pepper spray, cadaverine, etc., or a sticky foam or glue that impedes the further use of the implement being used to cut sheath 32.

Figure 4A:
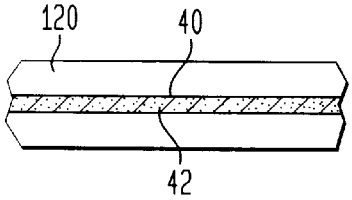
FIG. 4A is a schematic view of a section of the arresting net's strength member containing a chemical weapon system that is initiated when tension develops in the net.
Figure 4B:
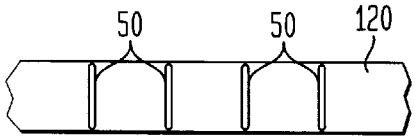
FIG. 4B is a schematic view of a section of the arresting net's strength member containing sharp objects that protrude therefrom when tension develops in the net.

A weapon system could also be initiated once tension begins to develop in net 12. Examples of such weapon systems are illustrated in FIGS. 4A and 4B where, in each case, tension in strength member 120 causes initiation of the weapon system. Since strength member 120 is typically a weave of synthetic fibers, the weapon systems in FIGS. 4A and 4B are contained within the weave (not shown) that makes up strength member 120. In FIG. 4A, a thin plastic tube or membrane 40 contains a chemical agent or substance 42. As tension builds in strength member 120, it naturally necks down and causes membrane 40 to rupture thereby allowing the release of chemical substance 42 through the weave of strength member 120. For example, if chemical substance 42 is a sticky foam or glue, net 12 will quickly bond to fleeing vessel 100 and any of its crew that it contacts. In FIG. 4B, a plurality of sharp objects 50 such as needles, barbs, hooks, etc. are embedded in the internal portions of strength member 120. As tension builds in strength member 120 and it necks down, sharp objects 50 will protrude therefrom thereby making movement against net 12 difficult and treacherous in a non-lethal fashion.

Figure 5:
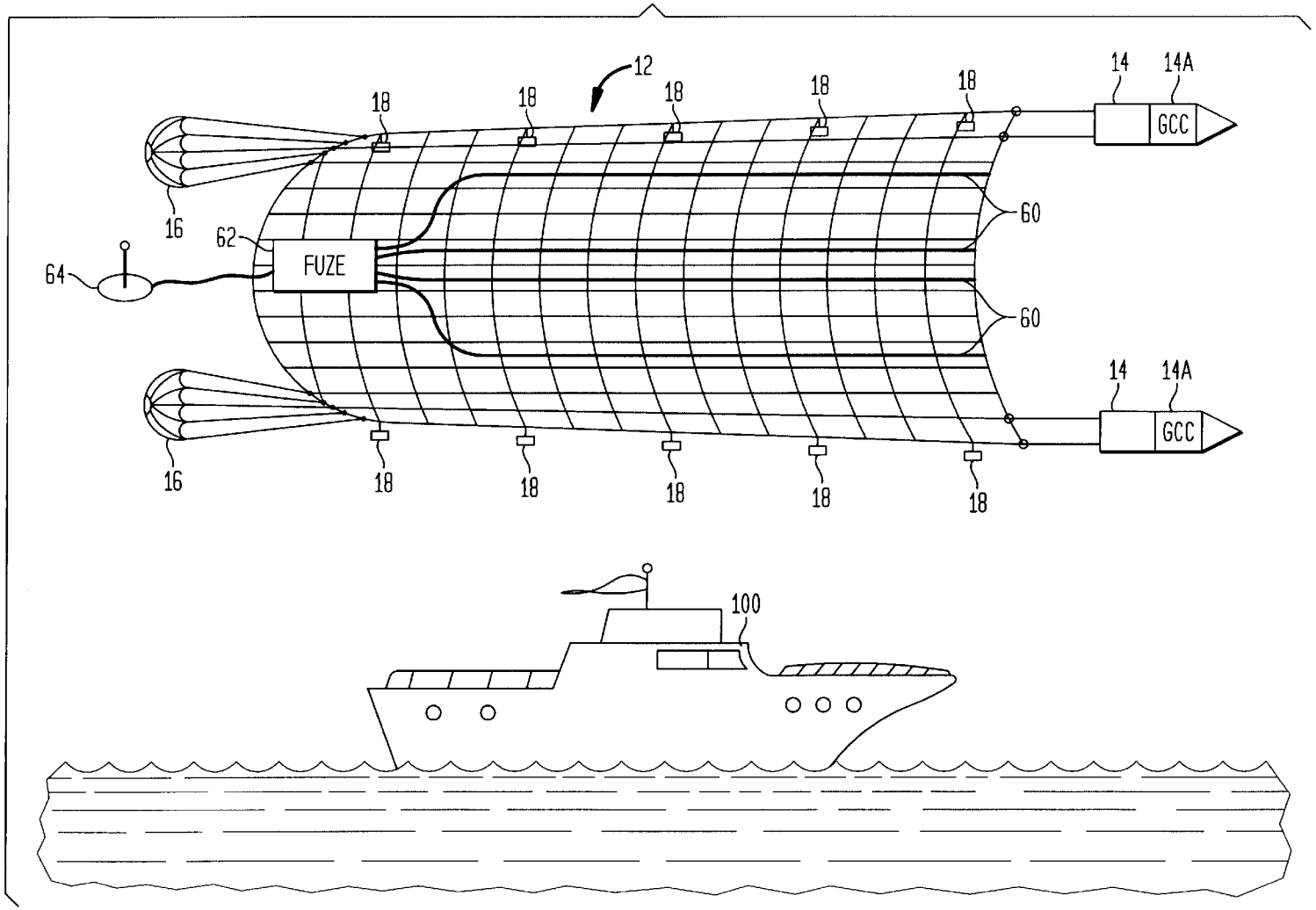
FIG. 5 is a schematic view of the present invention in its airborne phase and equipped with a remotely initiated weapon system.

The weapon system used in the present invention could also be remotely initiated once net 12 was draped on a fleeing vessel. In this way, the weapon system could be reserved as a deterrent from further resistance if the speed reduction provided by the net is insufficient to subdue the fleeing vessel. For example, as illustrated in FIG. 5, a plurality of detonating cords 60 can be attached to and extending throughout net 12. Detonating cords 60 are coupled to a fuze 62 that is activated by remotely-issued radio commands received at a floating antenna 64 once net 12 is draped on fleeing vessel 100. Detonating cords 60 would typically have an explosive grain density that would be sufficient to incapacitate the crew without being lethal.

Figure 6:
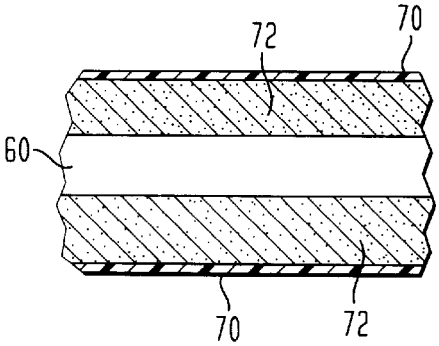
FIG. 6 is a schematic view of a section of a detonating cord and surrounded by a chemical-containing sheath.
Figure 7:
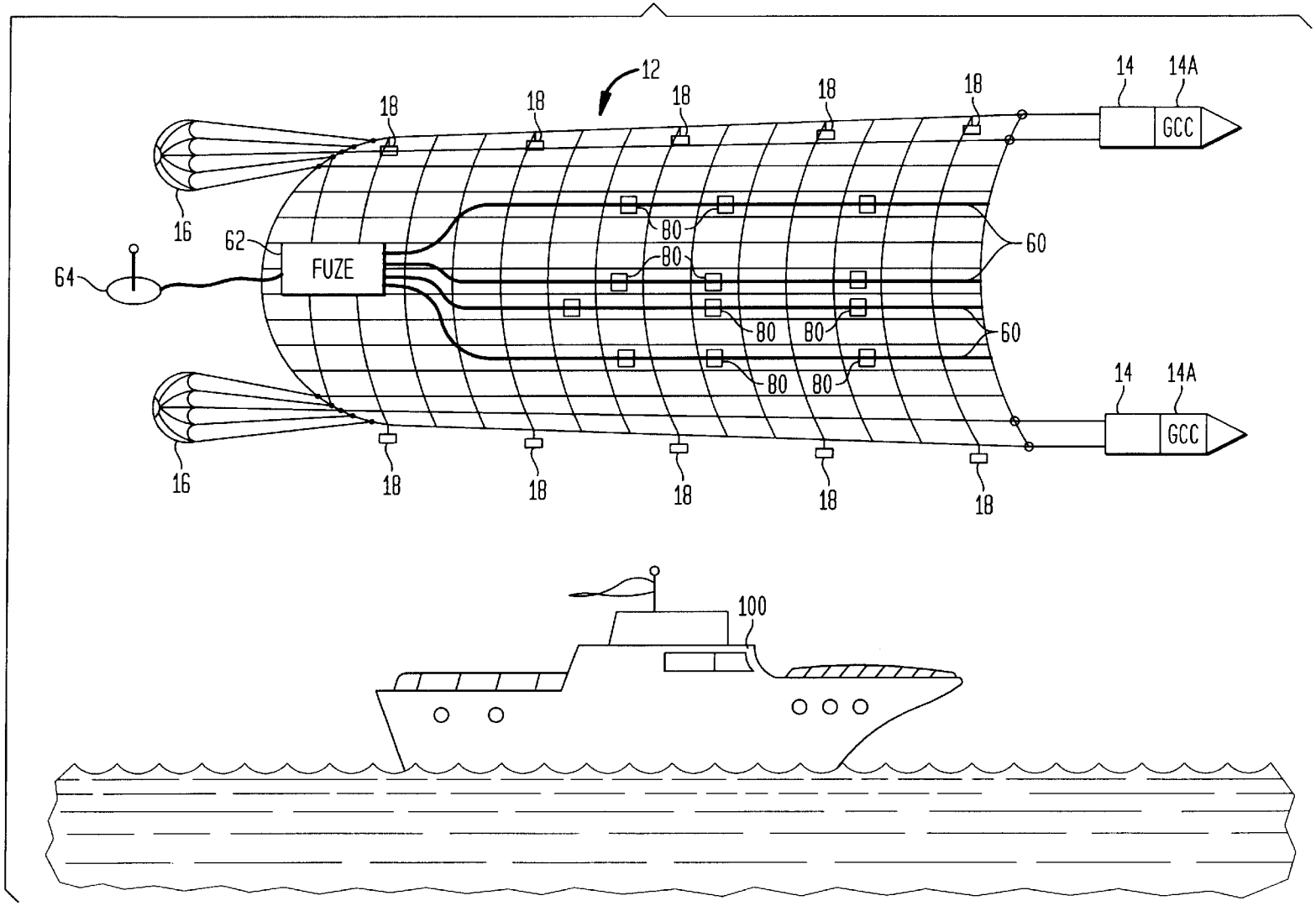
FIG. 7 is a schematic view of the present invention in its airborne phase and equipped with another embodiment of a remotely initiated weapon system.

An alternative to using just detonating cords is illustrated in FIG. 6 where a section of detonating cord 60 is surrounded by a sheath 70 that forms a bladder thereabout for retaining a chemical agent or substance 72. Sheath 70 can be continuous on cord 60 or formed as segments thereon. Chemical substance 72 could be any of the afore-mentioned chemical irritants. Chemical substance 72 could also be tear gas, a sticky foam or glue, a dispersible liquid fuel ignited by a separately-deployed pyrotechnic (not shown), or a chemical substance (e.g., powdered silicon carbide) that can be ingested by the air intake of fleeing vessel 100 in order to destroy its engines. Another way to deliver a chemical substance is to attach chemically-filled canisters 80 to detonating cord 60 as illustrated in FIG. 7. Each of canisters 80 is designed to rupture upon receiving the explosive train propagating along detonating cord 60.

Figure 8:
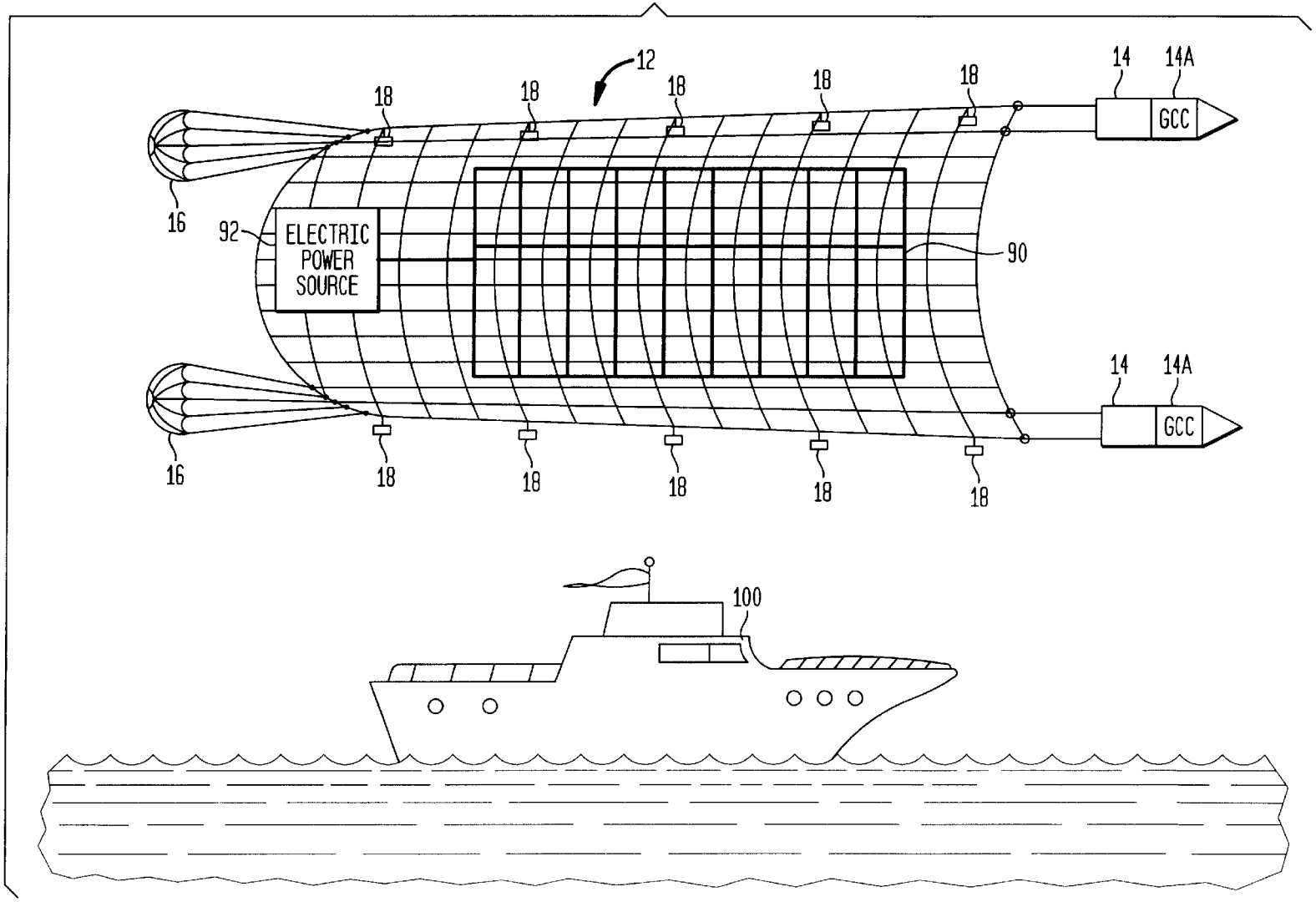
FIG. 8 is a schematic view of another embodiment of the resent invention in which an electric shock can be delivered.

A remotely-controlled weapon system could also be provided to deliver electrical energy in the form of an electric shock designed to incapacitate the crew or an electromagnetic pulse design to induce destructive stray voltages in the electronic components of fleeing vessel 100. FIG. 8 depicts an electric-shock type of weapon system where a bare-wire grid 90 is attached to net 12. Grid 90 is coupled to an electric power source 92. Power source 92 could be activated remotely as described above or, alternatively, could be a generator that produces electricity as net 12 is dragged through the water.

Figure 9:
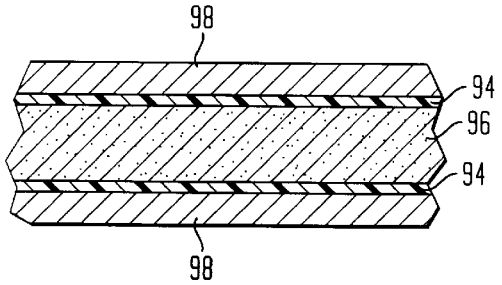
FIG. 9 is a schematic view of a section of an electromagnetic pulse (EMP) generator that can be coupled to the arresting net in the present invention.

FIG. 9 depicts a simple electromagnetic pulse (EMP) generator that can be attached to net 12 in the present invention. Briefly, the EMP generator includes a detonating cord sheath 94 filled with a combination of magnetic and explosive material 96 surrounded by a tubular permanent magnet 98. Upon explosive detonation at one end of the EMP generator, a fast-moving jet of molten magnetic and explosive material 96 moves through magnet 98. The high velocity movement of the magnetic material through magnet 98 causes a very sharp change in the surrounding magnetic field to produce a large EMP pulse. Examples of other EMP generation techniques are disclosed in U.S. Pat. Nos. 4,862,021, 5,301,362, and 6,005,305.

Figure 10:
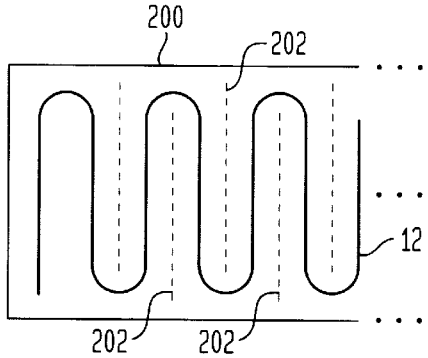
FIG. 10 is a schematic view of the arresting net in a folded configuration prior to deployment thereof.

Regardless of the particular embodiment used, net 12 (with or without an accompanying weapon system) will typically be folded in a packed configuration that unfurls either when rockets 14 are launched or sometime thereafter. For example, as illustrated in FIG. 10, a container 200 houses a folded configuration of net 12 until time of deployment. To prevent adjacent folds from sticking to one another, thin sheets 202 of material can be disposed between folds. Alternatively or additionally, net 12 can be dry-coated with talcum powder or any other non-stick material.

The advantages of the present invention are numerous. An arresting system is provided that can slow and/or incapacitate a fleeing vessel as the fleeing vessel tries its best to escape. The system can be used without seriously injuring any of the occupants of the vessel. The arresting system can be deployed safely from a pursuing seagoing vessel or aircraft since the system is not tethered to the pursuing vehicle. A variety of non-lethal weapon systems can be used to subdue the crew of fleeing vessel and/or the fleeing vessel's engine and electronic components.

Figure 11A:
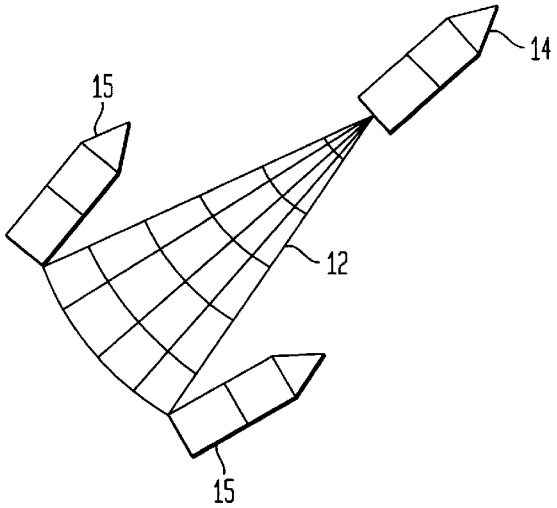
FIG. 11A is a schematic view of a triangle-shaped net configuration.
Figure 11B:
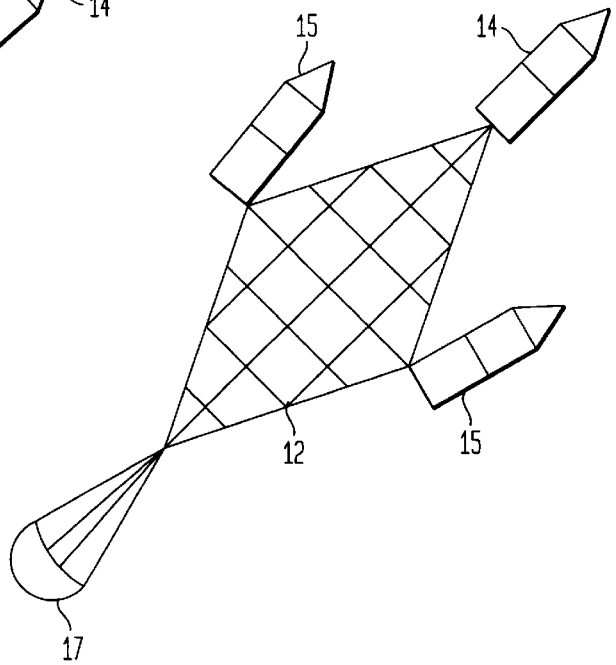
FIG. 11B is a schematic view of a diamond-shaped net configuration.

Although the invention has been described relative to a specific embodiment thereof, there are numerous variations and modifications that will be readily apparent to those skilled in the art in light of the above teachings. For example, the function of drag devices 18 could be incorporated directly into net 12. That is, the periphery of net 12 could be embodied by a tight mesh grid in order to create drag forces as the periphery of the net was dragged through the water. In terms of propelling net 12 through the air, another alternative could include the use of a single rocket and weights designed to vector outward from the direction of rocket travel. For example, net 12 could be deployed in a triangle pattern by a single rocket 14 and two aft-mounted vectoring weights 15 as illustrated in FIG. 11A. In FIG. 11B, net 12 is deployed in a diamond pattern by a single rocket 14, two mid-mounted vectoring weights 15 and an aft-mounted parachute 17. It is therefore to be understood that, within the scope of the appended claims, the invention may be practiced other than as specifically described.

What is claimed as new and desired to be secured by Letters Patent of the United States is:

1. A system for arresting a fleeing seagoing vessel, comprising:

a net having a periphery;

means for deploying said net from a platform to drape onto a seagoing vessel of interest such that a portion of said periphery resides in the water; and a plurality of drag-producing devices coupled to said periphery for generating drag forces at said portion of said periphery as said seagoing vessel moves through the water.

2. A system as in claim 1 wherein said net is constructed from a fibrous strength material.

3. A system as in claim 1 wherein said means for deploying includes at least one self-propelled vehicle coupled to said net and launched from said platform.

4. A system as in claim 1 further comprising a non-lethal weapon system coupled to said net.

5. A system as in claim 4 wherein said non-lethal weapon system is initiated when an attempt is made to cut said net.

6. A system as in claim 5 wherein said non-lethal weapon system generates an explosive event upon initiation.

7. A system as in claim 5 wherein said non-lethal weapon system releases a chemical agent upon initiation.

8. A system as in claim 5 wherein said non-lethal weapon system delivers electrical energy upon initiation.

9. A system as in claim 4 wherein said non-lethal weapon system is initiated by remote control.

10. A system as in claim 9 wherein said non-lethal weapon system generates an explosive event upon initiation.

11. A system as in claim 9 wherein said non-lethal weapon system releases a chemical agent upon initiation.

12. A system as in claim 9 wherein said non-lethal weapon system delivers electrical energy upon initiation.

13. A system as in claim 9 wherein said non-lethal weapon system delivers an electromagnetic pulse upon initiation.

14. A system as in claim 4 wherein said non-lethal weapon system is initiated by increased tension in said net resulting from said drag forces.

15. A system as in claim 14 wherein said non-lethal weapon system releases a chemical agent upon initiation.

16. A system as in claim 14 wherein said non-lethal weapon system exposes sharp objects upon initiation.

17. A system as in claim 14 wherein said net is packed in a series of folds prior to being deployed.

18. A system as in claim 17 further comprising means disposed between said folds for preventing said folds from sticking together as said net is deployed.

19. A system as in claim 1 wherein said means for deploying comprises:

first means for propelling said net through the air; and second means for opening said net to its fullest extent as said first means propels said net through the air.

20. A system as in claim 1 wherein said means for deploying includes guidance and control means.

21. A system for arresting a fleeing seagoing vessel, comprising:

a net having a periphery;

at least one self-propelled vehicle coupled to said net and launched from said platform for propelling said net through the air, wherein said net opens as said net is propelled through the air, said at least one self-propelled vehicle being directed along a path that causes said net to drape onto a seagoing vessel of interest such that a portion of said periphery resides in the water; and a plurality of drag-producing devices coupled to said periphery of said net for generating drag forces at said portion of said periphery as said seagoing vessel moves through the water.

22. A system as in claim 21 wherein said net is constructed from a fibrous strength material.

23. A system as in claim 21 further comprising a non-lethal weapon system coupled to said net.

24. A system as in claim 21 wherein said non-lethal weapon system is initiated when an attempt is made to cut said net.

25. A system as in claim 24 wherein said non-lethal weapon system generates an explosive event upon initiation.

26. A system as in claim 24 wherein said non-lethal weapon system releases a chemical agent upon initiation.

27. A system as in claim 24 wherein said non-lethal weapon system delivers electrical energy upon initiation.

28. A system as in claim 23 wherein said non-lethal weapon system is initiated by remote control.

29. A system as in claim 28 wherein said non-lethal weapon system generates an explosive event upon initiation.

30. A system as in claim 28 wherein said non-lethal weapon system releases a chemical agent upon initiation.

31. A system as in claim 28 wherein said non-lethal weapon system delivers electrical energy upon initiation.

32. A system as in claim 28 wherein said non-lethal weapon system delivers an electromagnetic pulse upon initiation.

33. A system as in claim 23 wherein said non-lethal weapon system is initiated by increased tension in said net resulting from said drag forces.

34. A system as in claim 33 wherein said non-lethal weapon system releases a chemical agent upon initiation.

35. A system as in claim 33 wherein said non-lethal weapon system exposes sharp objects upon initiation.

36. A system as in claim 21 wherein said net is packed in a series of folds prior to being deployed.

37. A system as in claim 36 further comprising means disposed between said folds for preventing said folds from sticking together as said net is deployed.

38. A system as in claim 21 further comprising guidance and control means coupled to said self-propelled vehicle for guiding said self-propelled vehicle through the air.

39. A system for arresting a fleeing seagoing vessel, comprising:

a net having a periphery;

at least one self-propelled vehicle coupled to said net and launched from said platform for propelling said net through the air;

means coupled to said net for causing said net to open as said net is propelled through the air, wherein said at least one self-propelled vehicle is directed along a path that causes said net so-opened to drape onto a seagoing vessel of interest such that a portion of said periphery resides in the water; and a plurality of drag-producing devices coupled to said periphery of said net for generating drag forces at said portion of said periphery as said seagoing vessel moves through the water.

40. A system as in claim 39 wherein said means comprises a plurality of devices coupled to said periphery of said net, said plurality of devices being selected from the group consisting of vectoring weights and parachutes.

41. A system as in claim 39 wherein said net is constructed from a fibrous strength material.

42. A system as in claim 39 further comprising a non-lethal weapon system coupled to said net.

43. A system as in claim 42 wherein said non-lethal weapon system is initiated when an attempt is made to cut said net.

44. A system as in claim 43 wherein said non-lethal weapon system generates an explosive event upon initiation.

45. A system as in claim 43 wherein said non-lethal weapon system releases a chemical agent upon initiation.

46. A system as in claim 43 wherein said non-lethal weapon system delivers electrical energy upon initiation.

47. A system as in claim 42 wherein said non-lethal weapon system is initiated by remote control.

48. A system as in claim 47 wherein said non-lethal weapon system generates an explosive event upon initiation.

49. A system as in claim 47 wherein said non-lethal weapon system releases a chemical agent upon initiation.

50. A system as in claim 47 wherein said non-lethal weapon system delivers electrical energy upon initiation.

51. A system as in claim 47 wherein said non-lethal weapon system delivers an electromagnetic pulse upon initiation.

52. A system as in claim 42 wherein said non-lethal weapon system is initiated by increased tension in said net resulting from said drag forces.

53. A system as in claim 52 wherein said non-lethal weapon system releases a chemical agent upon initiation.

54. A system as in claim 52 wherein said non-lethal weapon system exposes sharp objects upon initiation.

55. A system as in claim 39 wherein said net is packed in a series of folds prior to being deployed.

56. A system as in claim 55 further comprising means disposed between said folds for preventing said folds from sticking together as said net is deployed.

57. A system as in claim 39 further comprising guidance and control means coupled to said self-propelled vehicle for guiding said self-propelled vehicle through the air.

58. A system for arresting a fleeing seagoing vessel, comprising:

a net having a periphery;

at least one self-propelled vehicle coupled to said net for deploying said net from a platform to drape onto a seagoing vessel of interest such that a portion of said periphery resides in the water; and means coupled to said net for generating drag forces at said portion of said periphery as said seagoing vessel moves through the water.

59. A system for arresting a fleeing seagoing vessel, comprising:

a net having a periphery;

means for deploying said net from a platform to drape onto a seagoing vessel of interest such that a portion of said periphery resides in the water, said means for deploying comprising first means for propelling said net through the air and second means for opening said net to its fullest extent as said first means propels said net through the air; and means coupled to said net for generating drag forces at said portion of said periphery as said seagoing vessel moves through the water.

60. A system for arresting a fleeing seagoing vessel, comprising:

a net having a periphery;

means for deploying said net from a platform to drape onto a seagoing vessel of interest such that a portion of said periphery resides in the water, said means for deploying including guidance and control means; and means coupled to said net for generating drag forces at said portion of said periphery as said seagoing vessel moves through the water.

* * * * *